United States Patent [19]

Gottlieb

[11] Patent Number: 4,472,986

[45] Date of Patent: Sep. 25, 1984

[54] LEVER LOCKING WORM ADJUSTABLE WRENCH

[76] Inventor: Robert G. Gottlieb, 4809 W. 95th St., Overland Park, Kans. 66207

[21] Appl. No.: 428,306

[22] Filed: Sep. 29, 1982

[51] Int. Cl.[3] ..... B25B 13/16

[52] U.S. Cl. ..... 81/157

[58] Field of Search ..... 81/157, 165, 356

[56] References Cited

U.S. PATENT DOCUMENTS

| | | | |
|---|---|---|---|
| 1,181,654 | 5/1916 | Eifel . | |
| 1,407,528 | 2/1922 | Gordon | 81/157 |
| 1,410,627 | 3/1922 | Thomas | 81/157 |
| 1,503,662 | 8/1924 | Norton | 81/165 UX |
| 1,747,360 | 2/1930 | Giles | 81/165 X |
| 2,481,866 | 9/1949 | Petersen . | |
| 2,524,689 | 10/1950 | Westman . | |
| 3,190,154 | 6/1965 | Chapman | 81/165 X |
| 3,241,410 | 3/1966 | Paden . | |
| 3,608,405 | 9/1971 | Schmidt | 81/356 |
| 4,147,077 | 4/1979 | Tasato | 81/367 |
| 4,375,174 | 3/1983 | Shanley, Jr. | 81/165 |

*Primary Examiner*—James G. Smith

*Attorney, Agent, or Firm*—Litman, Day & McMahon

[57] ABSTRACT

A lever locking worm adjustable wrench includes a handle terminating in a fixed jaw, a movable jaw slidably received in the handle in opposing relation to the fixed jaw, and rack gear teeth formed on the movable jaw. A worm mounting arm has a worm gear rotatably mounted thereon and is pivotally mounted on the handle to move the worm gear in a direction substantially tangential to the direction of the rack. An operating lever is pivotally connected to the worm mounting arm and is connected by a toggle link to the handle. Upon movement of the lever toward the handle, the movable jaw is moved toward the fixed jaw to grippingly engage a workpiece, such as a nut or bolt head therebetween. The toggle link, operating lever, and handle cooperate to define an over-center locking mechanism whereby the movable jaw is releasably locked in gripping engagement with the workpiece against the fixed jaw.

14 Claims, 5 Drawing Figures

Fig. 1.
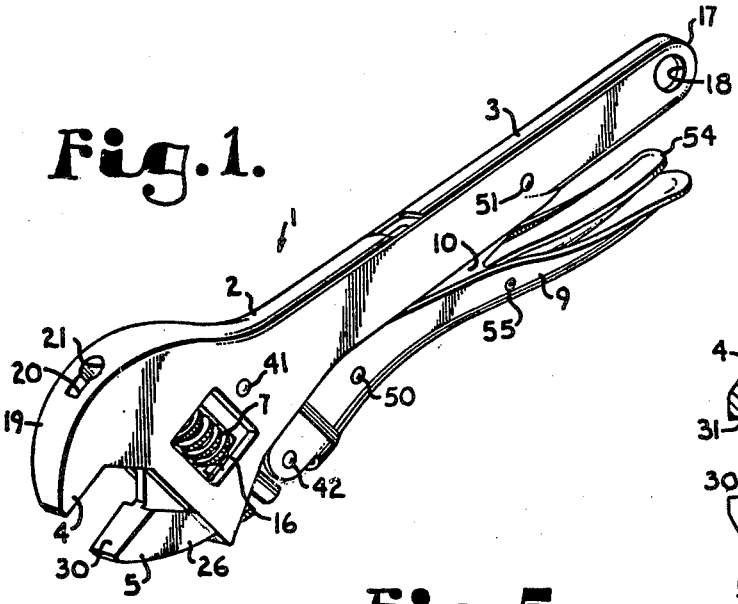
Fig. 4.
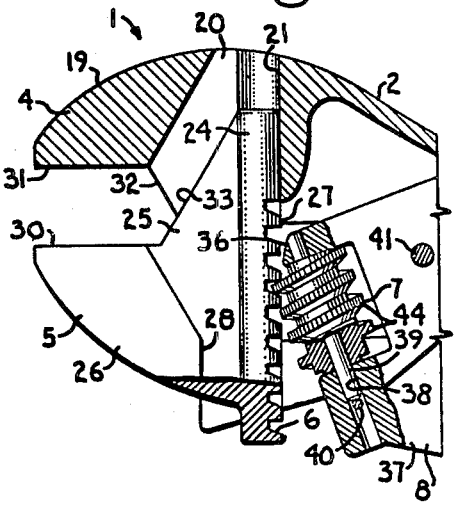
Fig. 5.
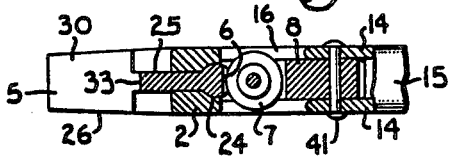
Fig. 2.
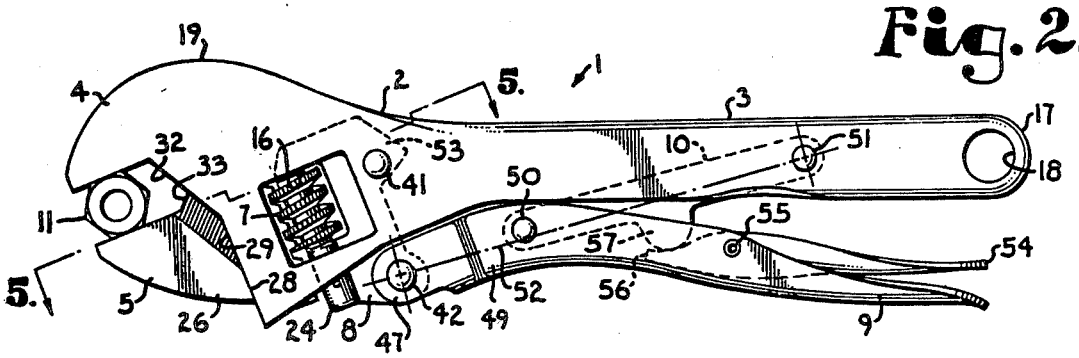
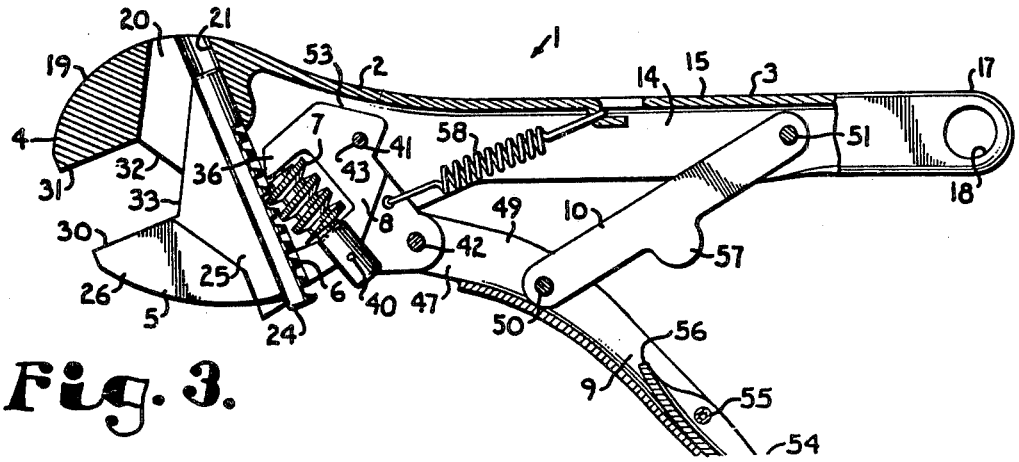
Fig. 3.

LEVER LOCKING WORM ADJUSTABLE WRENCH

FIELD OF THE INVENTION

The present invention relates to lever locking wrenches and, more particularly, to such a wrench wherein a worm gear mounted on a pivotal arm is pivoted into substantially tangential meshing engagement with a rack gear on a movable jaw to thereby slide same into gripping engagement with a workpiece against a fixed jaw of the wrench.

BACKGROUND OF THE INVENTION

Although a fixed wrench of the proper size is generally recognized as the most appropriate tool for turning a nut or bolt head, most tool kits include an adjustable wrench of some sort for convenience. The principal disadvantage of adjustable wrenches is that if the jaws are adjusted to snugly fit the nut to be turned, it is difficult to engage the wrench with the nut. Conversely, if the wrench jaws are separated enough to facilitate engagement with the nut, the common result is that the wrench slips off the nut as torque is applied, often damaging the nut and injuring the user of the wrench. If, on the other hand, the wrench is tightened after placement on the nut, it is difficult to remove the wrench without loosening same, such that in working in a confined spaced, which is often the case, the wrench must be repeadedly, and laboriously placed on the nut, tightened, turned through a small angle, loosened, removed, and placed on the nut in a different position.

In order to overcome such difficulties, lever locking wrenches of various types have been devised. Such wrenches are often constructed in a manner similar to lever locking pliers, such as the well known "Vise-Grip" pliers, wherein an operating lever is releasably latched by an over-center locking mechanism as the lever is closed toward the handle thereby clamping the jaws onto a workpiece. In lever locking wrenches, the jaw faces are generally planar and means is provided for maintaining a parallel relationship of the jaws, usually by mounting the movable jaw in a linear guide track. The advantage of adjustable lever locking wrenches over other types of adjustable wrenches is that when the operating lever is released, there is sufficient clearance between the jaws to facilitate placement about the nut. When the operating lever is closed, the jaws are positively clamped against the nut thereby preventing slippage of the wrench from the nut.

In most of the known types of lever locking wrenches, the spacing of the jaws is adjusted by means of a bolt having a knurled head at the end of the handle, opposite the jaw end of the wrench. Such placement of the adjustment bolt, while feasible as an adjustment means, requires that both hands of the user be employed to adjust the spacing of the jaws. A more convenient adjustment means is a worm and rack gear arrangement placed at the jaw end of the wrench. In one known worm adjustable lever locking wrench, the movable jaw is slidably mounted in an arm which is pivotally connected to the handle having the fixed jaw thereon. A worm mounted on the arm engages a rack on the movable jaw. The wrench also includes an adjustment bolt at the end of the handle. While the two adjustment means provide for a wide range of spacings of the jaws, it is doubtful if the jaw faces (shown as toothed) would remain parallel at the extremes of the adjustment range of the bolt. Further, the worm adjustment structure at the jaw end is rather bulky which would limit the utility of the tool in confined spaces. In another known worm adjusted lever locking wrench, an over-center latched set screw bears against the spindle of the worm gear to slide the movable jaw into clamping engagement with a workpiece. The tool appears quite useful in most respects. However, the latch release lever appears to be inconveniently close to the wrench handle such that the two hands of the user would probably be required for operation of the release lever.

SUMMARY OF THE INVENTION

In the lever locking worm adjustable wrench of the present invention, the movable jaw is slidably mounted in a guide track formed in the body or handle of the wrench, thereby maintaining a parallel relationship with the fixed jaw. The worm gear is mounted on a mounting arm and is pivoted by action of the operating lever in a direction which is substantially tangential to the rack gear on the movable jaw. The result is a convenient to use, compact, and positively gripping adjustable wrench.

OBJECTS OF THE INVENTION

The principal objects of the present are: to provide an improved adjustable wrench; to provide such a wrench which securely engages a gripped workpiece such as a nut, bolt head, or the like to prevent damage thereto in turning same and possible injury to the user from slippage of the wrench from the workpiece; to provide such a wrench which is easily released from the workpiece; to provide such a wrench having substantially flat and parallel jaw faces; to provide such a wrench wherein the spacing between the jaws is adjusted by means of a worm gear engaging a rack gear on the movable jaw; to provide such a wrench wherein the worm gear is positioned on an arm to engage the rack in a substantially tangential motion to thereby slide the movable jaw toward and away from the fixed jaw as the operating lever is moved respectively toward and away from the handle; to provide such a wrench wherein the movable jaw is secured in a gripping position by means of an over-center lock mechanism including the operating lever, a toggle link, and a handle of the wrench; to provide such a wrench wherein the movable jaw can be adjusted for the desired workpiece and the wrench can be clamped thereon by an operator substantially using one hand; to provide such a wrench which is relatively compact in size; and to provide such an adjustable wrench which is economical to manufacture, durable and positive in operation, convenient in use and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of the lever locking worm adjustable wrench according to the present invention.

FIG. 2 is a side elevational view of the wrench and illustrates the components of the wrench in the gripping positions thereof.

FIG. 3 is a side elevational view of the wrench with portions broken away to illustrate internal details of the wrench with the wrench components shown in the released positions thereof.

FIG. 4 is an enlarged, fragmentary longitudinal sectional view of the wrench with the movable jaw, worm gear, and worm mounting arm shown in the released positions thereof.

FIG. 5 is a fragmentary sectional view taken on line 5—5 of FIG. 2 and illustrates the relationship of the worm and rack gears in the gripping positions thereof.

DETAILED DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a lever locking worm adjustable wrench including a wrench body 2 having a handle 3 at one end and a fixed jaw 4 at the other end thereof. A movable jaw 5 is slidably mounted in the body 2 in opposing relation to the fixed jaw 4. The movable jaw 5 has a rack gear 6 formed thereon for cooperation with a worm gear 7 to adjust the spacing between the jaws 4 and 5. The worm gear 7 is rotatably mounted on a worm mounting arm or carrier 8 which is pivotally connected to the body 2. An operating lever 9 is pivotally connected to the carrier 8 and by means of a toggle link 10 to the handle 3. The lever 9 is operable to pivot the carrier 8 to thereby slide the movable jaw 5 into and out of gripping engagement with a workpiece such a nut 11, bolt head, or the like.

The body 2, handle 3, and fixed jaw 4 are preferably an integral member. The handle 3 and body 2 are substantially channel shaped, including side walls 14 and an end wall 15, to receive the worm carrier 8 and toggle link 10 therein. Apertures or windows 16 are formed in each of the side walls 14 for access to the worm gear 7 for turning same. The side walls 14 at the extreme end 17 of the handle 3 may include aligned hanger apertures 18 whereby the wrench 1 may be hung on a hook or nail in a workshop. At the jaw end 19 of the body 2, a web slot 20 and cylindrical guide track 21 are formed to receive the movable jaw 5 therein. The body and handle are preferably formed of steel and may be manufactured by any suitable process. For example, the handle and a portion of the body may be stamped or forged. The jaw end 19 may be cast and machined. Then the two sections may be joined as by welding, the weld then being machined to the desired smoothness.

The movable jaw member 5 includes a cylindrical guide rib 24 connected by a web 25 to a movable jaw head 26. The rib 24 slides in the guide track 21 and has rack gear teeth 27 formed thereon to define the rack gear 6. The web 25 slides in the web slot 20. The jaw head 26 includes shoulders 28 which engage bearing surfaces 29 formed at the ends of the side walls 14 of the body 2. The movable jaw 5 preferably includes a planar or flat jaw face 30 which opposes a planar fixed jaw face 31 of the fixed jaw 4. The cylindrical guide track 21 and contact between the shoulders 28 and bearing surfaces 29 cooperate to restrict the motion of the movable jaw 5 to linear motion in the direction of the axes of the guide track 21 and rib 24. By this means, the faces 30 and 31 of the fixed and movable jaws are maintained in parallel relation, such that the wrench 1 functions as a true wrench. The bearing surfaces 29 may be connected to the fixed jaw face 31 by workpiece contact surfaces 32 oriented at 120 degrees to the jaw face 31 for contact with hexagonal workpieces such as hexagonal nuts to better distribute the forces applied by the wrench 1 to the nut 11. Similarly, the web 25 may include a contact surface 33 connecting with the movable jaw face 30 and oriented at 120 degrees thereto for the same purpose.

The worm mounting arm or carrier 8 is a flat, substantially U-shaped member. Legs 36 and 37 of the arm 8 have aligned bores 38 therethrough to receive a spindle 39 on which the worm gear 7 is mounted. The spindle 39 may be fixed within the bore 38 by means such as a pin 40. The arm 8 is connected to the side walls 14 of the body 2 by means such as a rivet 41. Similarly, a rivet 42 may be employed to connect the operating lever 9 to the arm 8. The position of a pivot joint bore 43 in the arm 8 which receives the rivet 41, in relation to position of the worm gear 7, is very important for proper functioning of the wrench 1.

It is desirable for the sub-assembly of the worm gear 7 and worm carrier 8 to function in the manner of a pinion gear engaging the rack gear 6 in order for the movable jaw 5 to be moved into gripping contact with the nut 11. That is, it is desirable that the helical threads 44 of the worm gear 7 engage the teeth 27 of the rack gear 6 in a substantially tangential manner, as the carrier 8 is pivoted. For this to occur, the bore 43 must be spaced from the worm gear 7 and positioned between lines perpendicular to the spindle 39 which extend toward the bore 43 from the ends of the worm gear 7. Stated in another manner, a line extending from the pivot axis of the carrier 8, that is the bore 43, and perpendicular to the axis of rotation of the worm gear 7, that is the spindle 39, should intersect the worm gear 7. The worm 7, thus, has a dual gear function: namely, the adjustment of the spacing between the jaws 4 and 5 for gripping a workpiece 11 and the transfer of gripping and releasing motion from the arm 8 to the movable jaw 5. The edges of the threads 44 of the worm gear 7 are preferably milled or knurled to facilitate gripping same for adjustment of the position of the movable jaw 5.

The operating lever 9 may be any suitable configuration and is illustrated as a channel-shaped member having end ears 47 through which the rivet 42 extends to connect the lever 9 to the worm carrier 8. The lever 9 has a released position (FIG. 3) wherein it is angled away from the handle 3 and a gripping position (FIG. 2) wherein it is substantially parallel to the handle 3. Upon movement of the lever 9 toward the released position, the worm carrier 8 is moved such that the movable jaw 5 is slid away from the fixed jaw 4 to thereby release the workpiece 11 from the jaws. Conversely, movement of the lever 9 toward the gripping position effects movement of the worm carrier 8 to thereby slide the movable jaw 5 toward the fixed jaw 4 for clamping engagement with the workpiece 11.

The lever 9, toggle link 10, handle 3, and carrier 8 define an over-center locking or latching mechanism in the gripping position of the lever 9 in cooperation with the jaws 4 and 5 and a workpiece 11 therebetween. As the operating lever 9 is moved toward the gripping position, the carrier 8 reaches a position at which no further pivoting movement thereof is possible because of gripping contact between the jaws 4 and 5 and the workpiece 11 therebetween. At this position of the carrier 8, the arm joint defined by the rivet 42 becomes stationary; however, the lever 9 has not reached the gripping position thereof. As movement of the lever 9 toward the gripping position continues, a segment 49 between the rivet 42 and a lever joint defined by a rivet 50 connecting the toggle link 10 to the lever 9, and the toggle link 10 between the rivet 50 and a handle joint defined by a rivet 51 connecting the link 10 to the handle 3 are increasingly compressed. Maximum compression occurs when the rivet 50 is centered on a maximum compression line 52 (FIG. 2) defined by the rivets 42 and 51. As movement of the lever 9 continues such that the rivet 50 passes the line 52, the compression drops off or decreases. However, contact of the lever 9 with the handle 3 or other stopping means prevents further movement of the lever 9 toward the handle 2. This position of the lever 9 is defined as the gripping position thereof, and in this position the jaws 4 and 5 positively and forcibly grip the workpiece 11. The worm carrier 8 may be provided with a stop member 53 to limit movement of the carrier 8 to prevent same from pivoting far enough to allow the movable jaw 5 to slide out of the body 2 by contact of the stop 53 with the end wall 15 of the body 2.

It would be possible to release the lever 9 simply by forcing the lever away from the handle 3. In order to facilitate the release of the wrench 1, the operating lever 9 is provided with a release lever 54 which is pivotally connected thereto by means such as a rivet or roll pin 55. The release lever 54 has a prying end 56 which engages means such as a projection 57 on the toggle link 10. Upon movement of the release lever 54 toward the operating lever 9, the lever 9 is forced away from the handle 3, thereby moving the rivet 50 past the line 52 in the direction away from the handle 3. Such action releases the over-center locking mechanism, thereby releasing the movable jaw 5 from the workpiece 11. A tension spring 58 may be connected between the worm carrier 8 and the handle 3 to resiliently urge the carrier toward the handle to thereby pivot the lever 9 away from the handle 3 about the rivet 50 and to thereby quickly release the jaws 4 and 5 from the workpiece 11.

In use of the wrench 1 to turn a nut 11, or other similar workpiece, the required spacing of the movable jaw 5 must first be adjusted to an estimated spacing in relation to the fixed jaw 5. The wrench is then applied to the nut 11 and the operating lever 9 is closed toward the handle. If the spacing is too large, the over-center locking mechanism does not function, or does not function positively, either fact being readily apparent to the workman. However, if the spacing is too small, the lever 9 cannot be closed all the way to the handle 3. In this case, the lever 9 is open, and the spacing of the jaws is appropriately adjusted. When the jaw spacing has been properly adjusted and the wrench clamped onto the nut, the jaws 4 and 5 clampingly engage the nut such that same can be torqued without fear of damage thereto. If the work space is confined, the wrench may be repeatedly clamped onto the nut, turned a short distance, removed, and repositioned. The placement of the worm gear 7 at the jaw end 19 of the wrench allows adjustment of the wrench with one hand. Similarly, the operating lever can be opened and closed with one hand. Further, placement of most of the wrench components within the body 2 result in a compact arrangement which is scarcely more bulky than a conventional adjustable end wrench but which is functionally superior thereto.

It is to be understood that while certain forms of the present invention have been illustrated and described herein, it is not to be limited to the specific forms or arrangement of parts described and shown.

What is claimed and desired to secure by Letters Patent is as follows:

1. A lever actuated adjustable wrench comprising:

(a) a handle terminating in a first jaw fixed relative to said handle;

(b) a second jaw movable relative to said first jaw;

(c) an operating lever connected to and pivotable toward and away from said handle;

(d) said second jaw having a rack gear thereon and being slidably mounted in opposing relation to said first jaw;

(e) a worm gear mating with said rack gear and adapted to adjust the position of said second jaw in relation to said first jaw by rotation of said worm gear engaging said rack gear;

(f) a worm gear carrier pivotally connected to said handle at a location spaced from the axis of the worm gear and said carrier being pivotally connected to said operating lever at spaced locations respectively thereon; said worm gear being mounted on said worm gear carrier so as to substantially tangentially mesh with said rack gear upon pivoting of said operating lever toward said handle such that said wrench is in an operational configuration wherein said second jaw is urged toward said first jaw; and (g) further one end of said worm gear is pivoted away from said rack gear upon pivoting of said operating lever away from said handle such that said wrench is in a released configuration wherein said second jaw is slid away from said first jaw.

2. A wrench as set forth in claim 1 wherein:

(a) said carrier is connected to said handle by a pivot joint; and (b) said pivot joint is positioned between lines which are perpendicular to an axis of rotation of said worm gear and which intersect respectively the opposite ends of said worm gear and is located on an opposite side of said worm gear from said rack gear.

3. A wrench as set forth in claim 1 including a spring connected between said handle and said worm gear carrier, said spring resiliently urging said carrier away from said rack gear and said operating lever toward said released position.

4. A wrench as set forth in claim 1 wherein:

(a) said operating lever is connected to said handle by means of a toggle link pivotally connnected to said lever and said handle;

(b) said link cooperates with said handle, said lever, and said worm mounting arm to define an over-center locking mechanism in a gripping position of said lever to maintain said operating lever in said gripping position.

5. A wrench as set forth in claim 4 including a release lever pivotally connected to said operating lever and having a prying end engaging said toggle link in said gripping position of said operating lever, said release lever being operable to pry said operating lever away from said handle thereby releasing said over-center locking mechanism and releasing said movable jaw from said gripping position.

6. A wrench as set forth in claim 1 including over-center locking means associated with said wrench, said locking means operating in a gripping position of said operating lever to maintain said movable jaw in gripping engagement with a workpiece between said jaws.

7. The wrench as set forth in claim 2 wherein:

(a) said carrier includes a stop member for cooperating with said handle to limit pivoting of said carrier relative to said handle such that said worm gear is always maintained in mating association with said rack gear.

8. A lever locking adjustable wrench comprising:

(a) a handle;

(b) a fixed jaw positioned at an end of said handle;

(c) a movable jaw slidably received in said handle in opposing, substantially parallel relation to said fixed jaw;

(d) an operating lever operatively connected to said handle for movement away from said handle to a released position of said lever and toward said handle to a gripping position of said lever;

(e) a rack gear formed on said movable jaw;

(f) a worm mounting arm pivotally connected to said handle and to said operating lever;

(g) a worm gear having an axis of rotation and being rotatably mounted on said worm mounting arm at a position thereon for motion to effect substantially tangential meshing engagement with said rack gear upon the movement of said operating lever whereby said movable jaw is slid away from said fixed jaw upon movement of said operating lever toward said released position and whereby said movable jaw is slid toward said fixed jaw upon movement of said operating lever toward said gripping position; said worm mounting arm being pivotally connected to said handle at a location spaced from the axis of rotation of said worm gear such that pivotal movement of said worm gear arm rotates one end of said worm gear in and out of contact with said rack gear while an opposite end of said worm gear is always in contact with said rack gear; and (h) over-center locking means connecting said operating lever to said handle and operative to releasably lock said operating lever in said gripping position to thereby lock said movable jaw in gripping engagment with a workpiece against said fixed jaw.

9. A wrench as set forth in claim 8 wherein the pivot joint by which said arm is connected to said handle is spaced from said worm gear and is positioned between lines which are perpendicular to an axis of rotation of said worm gear and which interset respectively the opposite ends of said worm gear.

10. A wrench as set forth in claim 8 wherein said over-center locking mechanism includes a toggle link pivotally connected between said handle and said operating lever.

11. A wrench as set forth in claim 10 including a release lever pivotally connected to said operating lever and having a prying end engaging said toggle link in said gripping position of said operating lever, said release lever being operable to pry said operating lever away from said handle thereby releasing said over-center locking mechanism and releasing said movable jaw from gripping engagement with said workpiece.

12. A wrench as set forth in claim 8 wherein said over-center locking mechanism includes:

(a) a toggle link pivotally connected to said handle by a handle joint and to said operating lever by a lever joint;

(b) the pivotal connection between said operating lever and said worm mounting arm being an arm joint;

(c) upon movement of said operating lever toward said gripping position, as said lever joint approaches a maximum compression line defined by said handle joint and said arm joint, said toggle link is increasingly compressed between said handle joint and said lever joint and said operating lever between said lever joint and said arm joint is increasingly compressed, the compression dropping off as said lever joint is moved closer to said handle than said maximum compression line; and (d) limit means to limit the movement of said lever joint toward said handle past said maximum compression line.

13. A wrench as set forth in claim 12 wherein said limit means is a stop member on said worm mounting arm which engages said handle in said gripping position of said operating lever.

14. A wrench as set forth in claim 8 including a spring connected between said handle and said worm mounting arm, said spring resiliently urging said arm away from said rack gear and said operating lever toward said released position.

* * * * *